United States Patent [19]

Brashears et al.

[11] Patent Number: 4,492,171

[45] Date of Patent: Jan. 8, 1985

[54] SOLID FUEL BURNER

[76] Inventors: David F. Brashears, 790 Palmetto St., Oviedo, Fla. 32765; Joseph T. Mollick, 122 Hickory Tree Rd., Longwood, Fla. 32750

[21] Appl. No.: 560,316

[22] Filed: Dec. 12, 1983

[51] Int. Cl.[3] ..... F23D 1/02

[52] U.S. Cl. ..... 110/261; 110/222; 110/232; 110/264; 110/265; 431/184

[58] Field of Search ..... 110/263, 264, 265, 347, 110/222, 232, 261; 431/184

[56] References Cited

U.S. PATENT DOCUMENTS

| | | | |
|---|---|---|---|
| 2,800,093 | 7/1957 | Burg | 110/264 |
| 3,007,084 | 10/1961 | Thomasian et al. | 431/284 |
| 4,221,174 | 9/1980 | Smith et al. | 110/265 |
| 4,249,471 | 2/1981 | Gunnerman | 110/261 X |
| 4,333,405 | 6/1982 | Michelfelder | 110/264 |
| 4,407,205 | 10/1983 | Beaufrere | 110/264 |
| 4,422,389 | 12/1983 | Schroder | 110/264 |

FOREIGN PATENT DOCUMENTS

| | | | |
|---|---|---|---|
| 532898 | 2/1922 | France | 110/262 |

*Primary Examiner*—Edward G. Favors
*Attorney, Agent, or Firm*—William M. Hobby, III

[57] ABSTRACT

A solid fuel burner apparatus is provided for burning low density, low mass fibrous fuels such as paper waste and biomass. The burner includes a combustion chamber having a solid fuel and primary air nozzle attached to one end thereof for directing pulverized solid fuel and air into the combustion chamber. The solid fuel and primary air nozzle has a spinning mechanism for spinning the solid fuel and air into the combustion chamber in one direction of rotation. A secondary air input is provided for feeding secondary air into the combustion chamber and includes means to spin the secondary air from the secondary air input into the combustion chamber in a direction opposite in rotation to the direction of rotation of the solid fuel and primary air. A gas fuel input has a flame disk and is positioned to feed gas into the combustion chamber in the center portion of the solid fuel and primary air nozzle to create additional stability in the combustion of the solid fuel in the combustion chamber. A second gas nozzle will allow the burner to operate entirely on gas where insufficient fuel is available.

14 Claims, 15 Drawing Figures

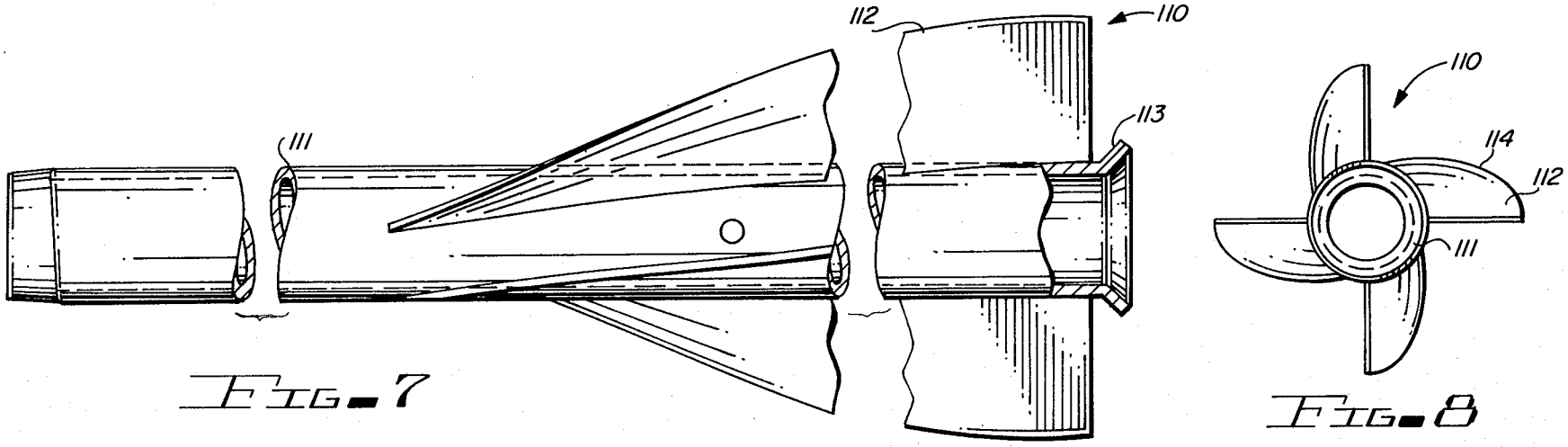
FIG. 7
FIG. 8
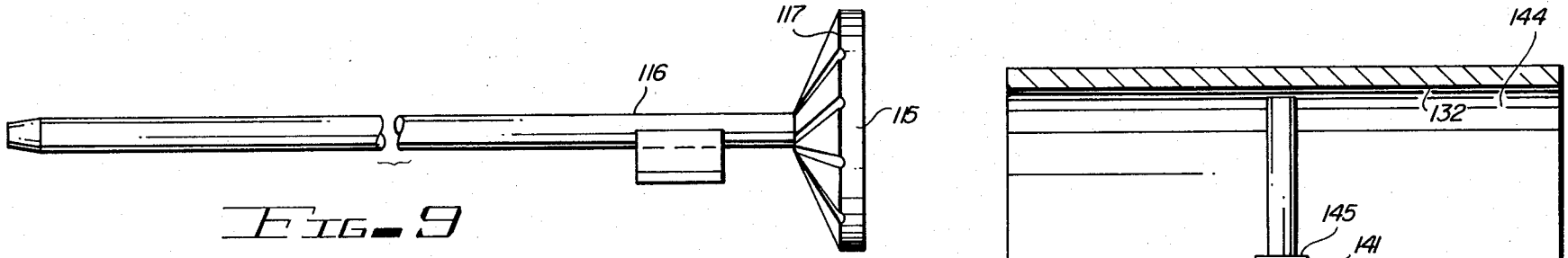
FIG. 9
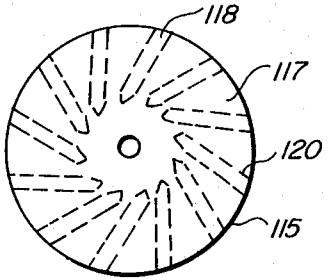
FIG. 10
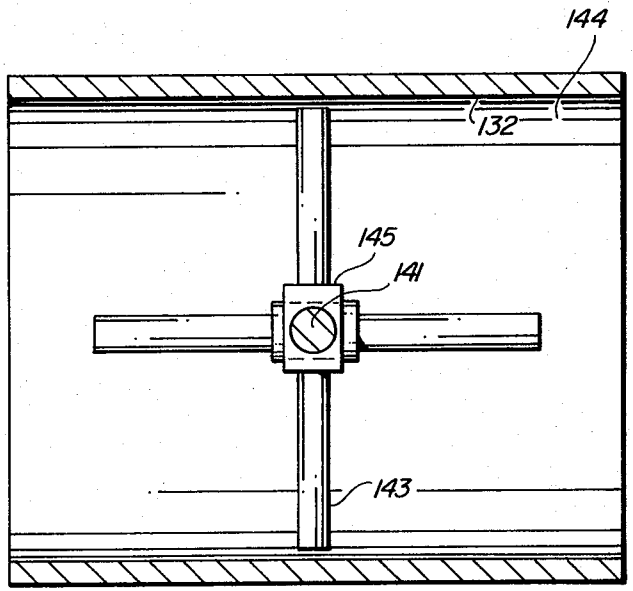
FIG. 15

SOLID FUEL BURNER

BACKGROUND OF THE INVENTION

The present invention relates to industrial burners and especially to industrial burners adapted to utilize a variety of fuels, including dehydrated pulverized organic materials.

Large, high capacity fuel burners are generally used in industries requiring drying of various materials. For example, such burners are required for operating large, rotary aggregate dryers and for kiln drying and processing of lime, bauxite, sand, coal, cement, and the like. In the making of asphalt roads, drying units are used for drying the aggregate before mixing with the asphalt.

In drying aggregate, as an example of an application of the fuel burners in consideration, a typical unit may have a rotating, horizontal drum 30 feet in length and 8 feet in diameter. The wet rock is introduced into one end of the drum, carried to the top of the drum and dropped back. The material is gradually carried to the opposite end of the drum and removed by a conveyor. A fuel burner which may have an outlet chamber of from one or more feet in diameter is placed at one end of the drum. The hot gases and air emanating from the burner are directed through the falling aggregate, known as the aggregate curtain, and serves to dry out all moisture from the material. An exhaust fan at the output end of the drum draws the heated air therethrough. The gas temperature at the burning input end may be on the order of 2400 F., dropping to about 350 F. at the opposite end of the drum. In large dryers such as described above, the burners are required to produce as much as 200 million btu's per hour.

In the past, a variety of fuels have been utilized in burners, but by in large, recent burners have used natural gas or fuel oil. In recent years, the absence of certain types of fuels in different parts of the country has resulted in entire manufacturing plants not being able to operate because of the lack of the type of fuel the plant is designed to use. As a result of this, more and more industrial burners are designed to use more than one type of fuel, and may for instance, use pulverized coal and natural gas with the ability to switch from one to the other as price and availability dictate. It has also been suggested in prior years to utilize wood or other organic materials in pulverized form for operating burners. However, when fuel oil and natural gas were less expensive, systems using organic energy were not economically feasible. But, with a rapidly escalating price of oil, industrial burners which utilize pulverized organic materials appear to be more desirable.

In the present invention, organic materials are dehydrated and pulverized to desirable moisture content of approximately twenty percent (20%). The desired particles are then forced at high pressure through pelletizing mills. The result is a pellet about a quarter of an inch in diameter and about three quarters of an inch long ($\frac{1}{4}\times\frac{3}{4}$). These pellets then are used in specially designed industrial burners, which may also have the capability of using gas or oil as a back-up fuel. The pellets can be made from any vegetable or organic matter, such as scrapboard chips, hay, sugar cane, left over from forest products industries, municipal refuge and other waste materials that are generally regarded as sources of pollution. The cost of the pellets utilizing various and otherwise waste materials is now competitive with other fuels and in many cases, the cities are now paying to haul organic materials to landfills and to separate and sell the usable material to a pellet manufacturer. The present burner can then take the pelletized material for operating the burners, but in the event that sufficient pelletized material is not available, the burner can alternatively switch from the pellet fuel to gas, or used dried organic material without pelletizing.

A typical U.S. patent which shows the use of pulverized fuel and oil either alone or simultaneously can be seen in U.S. Pat. No. 2,111,980 for a Combustion Apparatus. However, such prior art pulverized fuel burners have utilized pulverized coal and frequently have combined pulverization with gas or oil burners used in combination. Other powdered fuel burners can be seen in U.S. Pat. Nos. 1,618,808 and 3,777,678. These patents suggest using dual walled burners with combustion air being fed between the walls into the combustion chamber. U.S. Pat. No. 4,351,251 shows a burner for dehydrated pulerized organic materials. U.S. Pat. No. 3,391,981 to Voorheis, et al., shows a forced air draft burner for combustable gases having concentric annular air delivery paths and means for spinning air in two paths in opposite directions. The present invention is designed to operate primarily in connection with low density, low mass, fibrous fuels made from various forest products, waste, or reclaimed paper which has been dried and is fed by with air to the burner.

In constrast to the prior art, the present burner is for the specific solid fuel application of burning low density, low mass, fibrous fuels, such as pulverized paper waste or biomass and maintains flame stability while preventing the accumulation of the solid materials by the rotating of the solid material and air entering the combustion chamber in one direction and the rotation of secondary air in the opposite direction. The use of a specially designed gas nozzle maintains substantially 100% burn of the solid fuel by its positioning and feeding into the center of the solid fuel nozzle output. The burner is also capable of operating on gas only, as desired, when there is insufficient solid fuel. The present burner is designed for boilers or furnaces that do not have available hot secondary combustion air, such as applications requiring smaller sized burners which require adjustable flame lengths. The burners can be adjusted for different applications without internal changes to the burner or combustion chamber.

SUMMARY OF THE INVENTION

A solid fuel burner is provided which has a combustion chamber along with a solid fuel and primary air nozzle attached to the combustion chamber for directing pulverized solid fuel and air into the combustion chamber. The solid fuel and primary air nozzle has spinning vanes for spinning the solid fuel and air into the combustion chamber in one direction of rotation. A secondary air input means feeds secondary air into the combustion chamber in a secondary air spinning means spins the secondary air entering the combustion chamber in a direction of rotation opposite the direction from the solid fuel and primary air. The gas fuel input has a flame disk of specific design which can be adjusted and is positioned to feed gas into the combustion chamber and the center portion of the solid fuel and primary air nozzle. The overall combination allows a solid fuel burner to burn low density, low mass solid fuel and a second gas inlet will allow the burner to operate entirely on gas. The flame disk and the gas fuel input may have angled grooves extending along a combed surface at the output into the combustion chamber, thus creating regions of rich mixture at the exit openings, along with lean zones between the grooves which assist in stabilizing the solid fuel flame. The burner prevents the accumulation of solid material, while providing a substantially complete burn of the solid fuel.

BRIEF DESCRIPTION OF THE DRAWINGS

Other objects, features and advantages of the present invention will be apparent from the written description and the drawings, in which:

FIG. 7 is a cutaway side elevation of the spinners of the nozzle in accordance with FIGS. 5 and 6;

FIG. 8 is an end elevation of the spinners of FIG. 7;

FIG. 9 is a side elevation of a gas nozzle flame disk for use in the burner of FIG. 1;

FIG. 10 is an end sectional view of the flame disk of the gas nozzle portion of FIG. 9;

FIG. 15 is a sectional view taken on the line 15—15 of FIG. 14.

DESCRIPTION OF THE PREFERRED EMBODIMENTS

Figure 1:
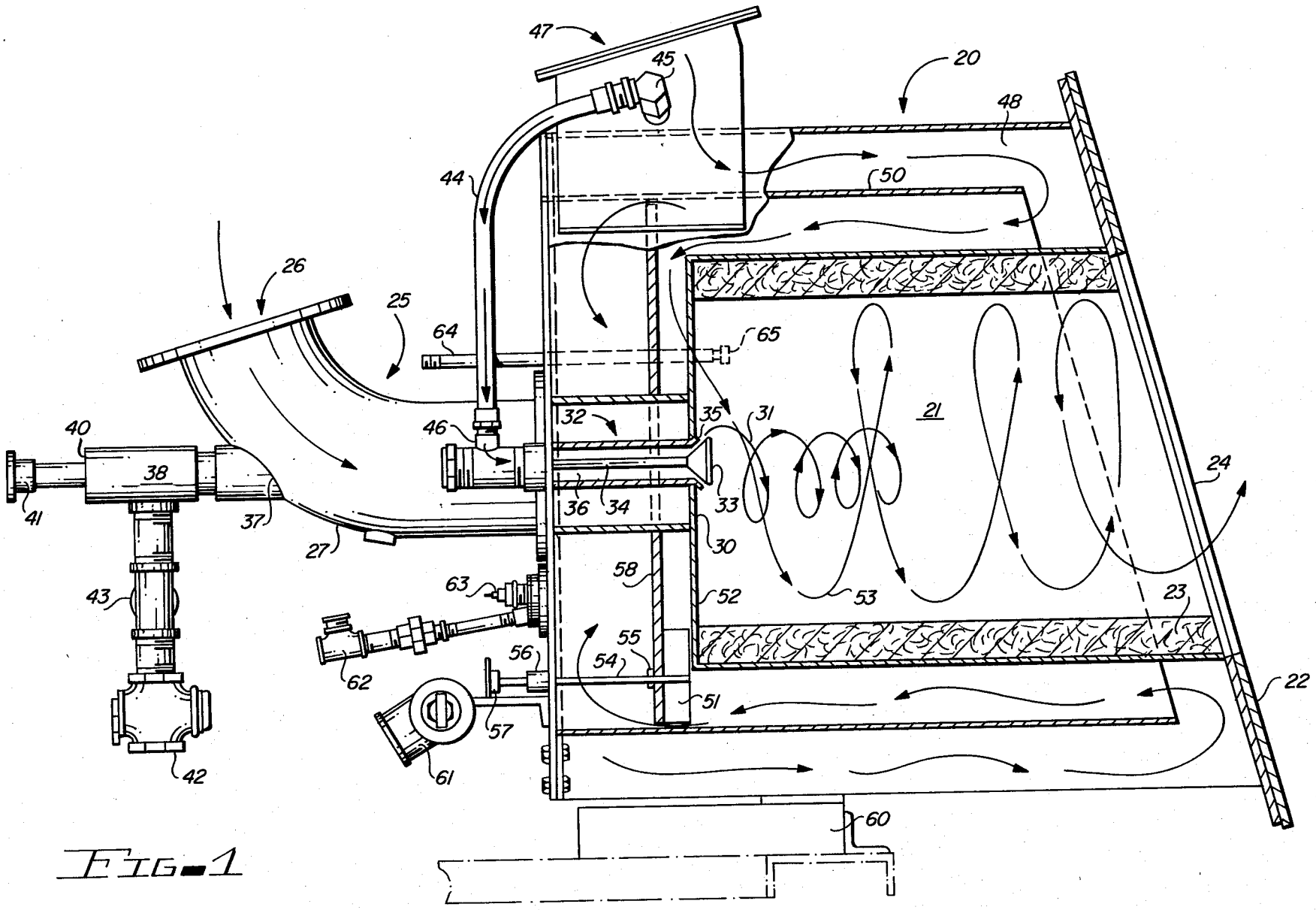
FIG. 1 is a sectional view of a solid fuel burner in accordance with the present invention.

Referring to the drawings and especially to FIG. 1, a solid fuel burner 20 is illustrated having a combustion chamber 21 and a furnace or boiler mounting plate 22. The combustion chamber is lined with a refractory material 23 and opens through the opening 24 into a furnace, or the like. The combustion chamber 21, as shown in FIG. 1, is cylindrical in shape with the opening 24 at one end and a solid fuel primary air nozzle 25 at the other end.

Figures 2, 3, 4, 11, 12, 13:
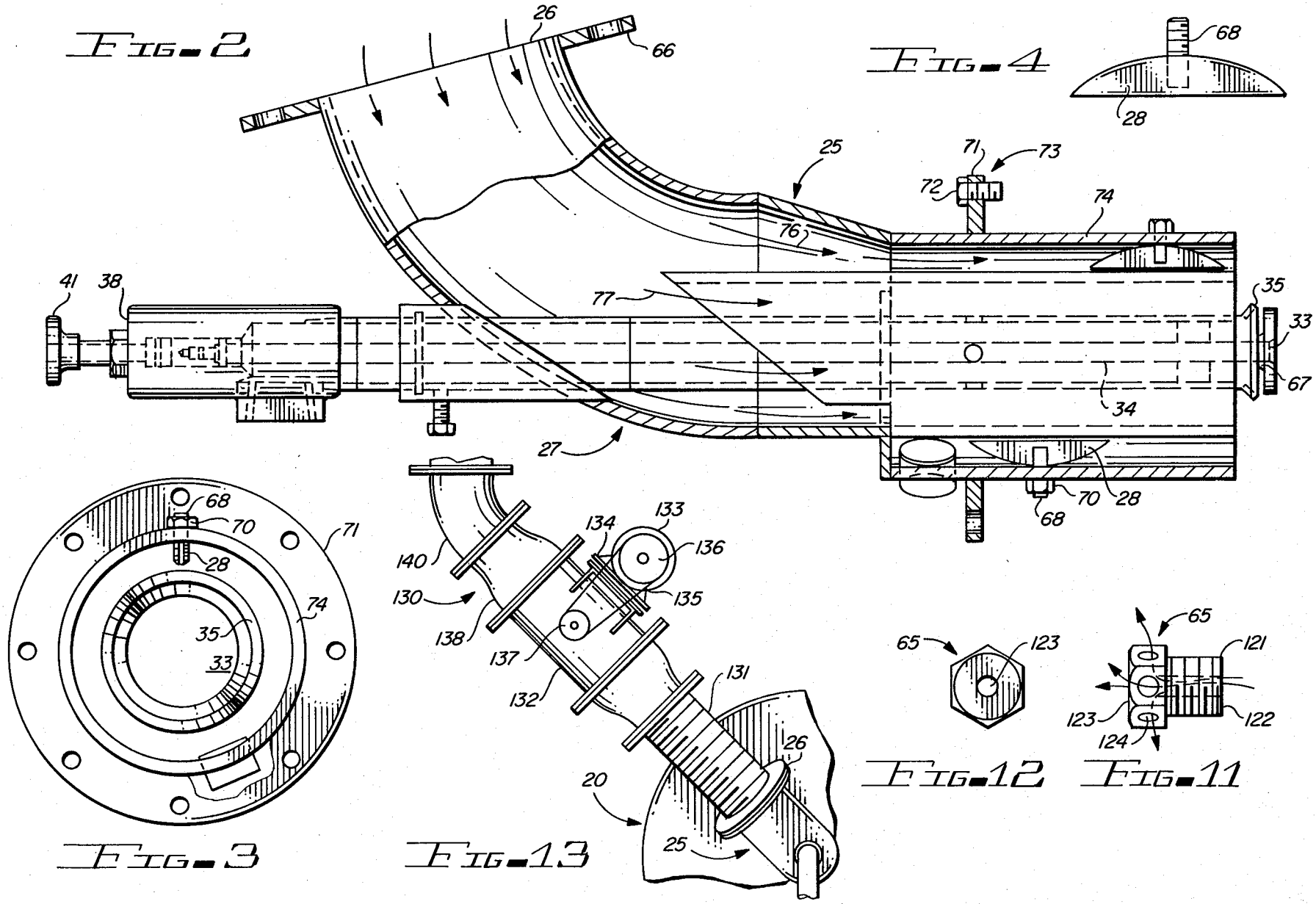
FIG. 2 is a sectional view of a solid fuel primary air nozzle and gas header in accordance with the burner of FIG. 1.
FIG. 3 is an end elevation of the nozzle of FIG. 2.
FIG. 4 is a side elevation of a spinning vane used in the nozzle of FIGS. 2 and 3.
FIG. 11 is a side elevation of a gas spud for use in the burner of FIG. 1.
FIG. 12 is an end elevation of the gas spud of FIG. 11.
FIG. 13 is a partial side elevation of the homogenizer unit place in the primary air and solid fuel input to the burner of FIG. 1.

Primary air and solid fuel enter through an opening 26 at one end of the nozzle, which nozzle passageway has an arcuate section 27 and an air and solid fuel spinning section with adjustable spinning vanes 28, as seen in FIG. 2. The pulverized solid fuel and air enters the nozzle at 26, is forced into a spin in one direction in accordance with the adjustment of the vanes 28 and out the nozzle opening 30 into the combustion chamber 21. The rotating in the embodiment shown in FIG. 1 is in accordance with the spiraling arrows 31. A gas nozzle 32 is placed directly in the center of the primary air solid fuel nozzle 25 and has a flame disk 33 on one end thereof supported by shaft 34 in a gas output cone 35 formed on the end of the nozzle passageway 36. The shaft 34 extends through the wall 37 of the nozzle 25 through a gas seal and head 38 and out an opening 40 and has an extension handle 41 thereon which allows for the adjustment of the flame disk 33 in and out of the cone shaped opening 35 to thereby adjust the output of gas and air into the combustion chamber 21. Primary gas is fed through primary gas throttle valve 42 through a gas pipe 43 to the gas seal and head 38 through the passageway 36 and out the nozzle opening 35. An air pipe 44 is connected with a coupling 45 to the secondary air source and directs air into the T-joint 46 of the gas nozzle 42, so that the output from the nozzle 35 is a combination of secondary air and primary gas input to the combustion chamber 21. The secondary air enters the burner through the opening 47, where it is connected to a secondary air blower, passes through the secondary air passageway 48 surrounding the burner combustion chamber 21 around an intermediate wall 50 and is directed by secondary air vanes 51 through an opening 52 surrounding the opening 30 of the primary air and solid fuel nozzle. The air vanes 51 are adjustable and direct the air in a direction shown by the spriral arrows 53 in a direction of rotation opposite that of the primary air and solid fuel shown by the spiraling arrows 31. This direction of spin opposite that of the solid fuel and primary air tends to stabilize the flame in the middle of the solid fuel burner, which in combination with the gas from the nozzle 35 fed out from which the center of the solid fuel and primary air entering the combustion chamber tends to provide a substantially complete burn of the solid fuel and prevents the accumulation of solid fuel in the combustion chamber 21. Secondary air vanes are mounted to a shaft 54 through a mounting ring assembly 55 and 56 to a handle 57 where the spin vane direction can be adjusted. The vane handle can also be moved in and out to position the spin vane along with the secondary air vane mounting ring 58. The position, as shown in the drawings, provides the greatest pressure drop and a corresponding high spin with the vanes being adjusted from outside the burner. The volume of secondary air can be increased by pulling the ring 58 and vane assembly outward, which decreases the effect of the spin vane and the spin effect for adjusting the shape of the flame in the combustion chamber 21. Thus, as can be seen, the primary gas fed through the nozzle 35, as well as the secondary air, can be adjusted from outside the burner for adjusting and controlling the flame in the combustion chamber 21. This view shows a mounting support 60 for the burner 20 as well as a secondary gas manifold 61 and a pilot gas pipe 62 connected adjacent the pilot burner 63. Also shown is a gas inlet pipe 64 having a gas spud 65 on the end thereof shaped to direct gas directly out the end and radiantly around the gas spud.

FIGS. 2 and 3 show the primary air and solid fuel nozzle 25 having the entrance 26 adjacent a flange 66 for the entrance of primary air and solid pulverized low density, low mass, fibrous fuel such as paper waste or biomass. The arcuate portion of the nozzle and the vanes 28 produce a mechanically sized distribution of solid fuel by forcing particles of higher mass to the inside of the radius and the lighter particles with less mass to the outer circular nozzle portion thereby surrounding the heavier particles with faster burning particles insuring the ignition of the heavier particles. The lightweight particles of smaller size have a higher surface area per size permitting faster ignition and burnout and aid the combustion of the heavier particles in the combustion chamber 21 of FIG. 1. In addition, the centrifugal flow of the particles around the curved surface 27 and the spinning effect of the vanes 28 are spun around the gas outlet 35, which is one cone shaped and has a flame disk 33 with a cone shaped portion 67 positioned therein and supported by a shaft 34 through the gas seal and gas head 38 to the handle 41. The flame disk 33 may be adjusted with the handle 61 outside the burner while the burner is in operation to assist in adjusting and controlling the flame in the combustion chamber. The vane 28 has a mounting shaft 68 and is bolted with a nut 70 to the wall of the nozzle 25. The entire nozzle assembly has an annular flange 71 and is mounted with a series of bolts 72 to the burner wall 73. The flange 71 is connected to the wall 74 of the nozzle 25.

As seen in FIG. 2, a series of straight arrows 76 indicate the zone of lightweight particles, which due to their light mass, find their way through the outer annulus of the solid fuel nozzle; while the arrows 77 indicate a zone of heavier particles which are forced to the outside radius centrifugal action.

Figure 5:
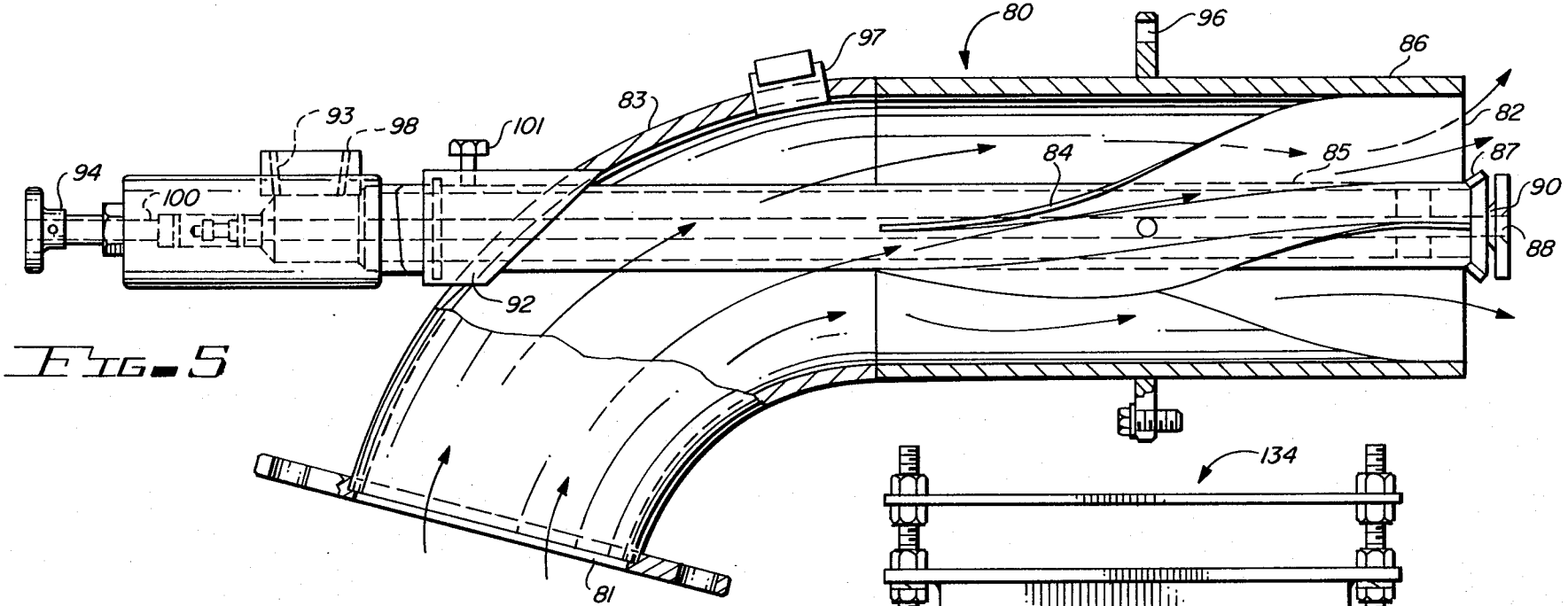
FIG. 5 is a sectional view of a second embodiment of a solid fuel and primary air nozzle for use in the burner of FIG. 1.
Figure 6:
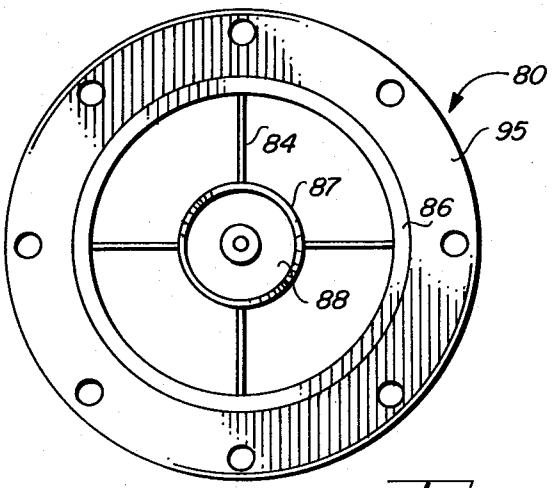
FIG. 6 is an end elevation of the nozzle of FIG. 5.

Turning the FIGS. 5 and 6, an alternate embodiment of a primary air solid fuel nozzle 80 is illustrated having an air and solid fuel inlet 81 in an air and solid fuel outlet 82 with an arcuate portion 83 and spinner vanes 84 having sharpened edges to provide a knife edge to the spinner vanes, which spinner vanes are mounted around the gas outlet 85 extending through the center of the wall 86. The primary gas nozzle 85 has a cone shaped opening 87 with a flame disk 88 mounted therein having a cone portion 90 and mounted to a central shaft 91. The central shaft extends out the back of the primary air and solid fuel nozzle wall 92 through the gas connection 93 and is connected to an exterior handle 94. The exterior handle 94 allows the flame disk 88 to be adjusted with various size gaps to direct the gas out the cone shaped nozzle 87 along the cone 90 to produce different size gaps. The minimum gap produces a highly turbulent stable flame with minimum gas flow and permits solid fuel stabilization. This gas nozzle can be used in place of the embodiment shown in FIGS. 2 and 3 in the burner shown in FIG. 1. The spinners 84 are of increasing diameter as they approach the opening 82 to the nozzle 80 and spin solid fuel and primary air. The gas from the flame disk 88 is spun in the same direction as the primary air, while the secondary air of FIG. 1 is spun in the opposite direction as the primary air and gas, thus creating a zone of turbulence for mixing of the fuel and air and for burner stability. The spinner 84 is specifically designed for solid fuels with low weight and density and high fibrousity. The minimum pressure drop across the solid fuel nozzle and minimal internal obstructions of the sharpened edge spinning blades prevent the solid fuel from clinging to the nozzle and causing blockage. An annular flange 95 has a plurality of apertures 96 therethrough and is attached to the wall 86 of the nozzle 80 and may be attached with bolts to a burner in accordance with FIG. 1. This solid fuel primary air and gas nozzle also has a pipe plug 97 through the wall 86 and has a gas connection opening 98 for feeding gas into the pipe 85. A sealed coupling 100 seals the shaft 91 against the leakage of gas. A locking screw 101 permits locking of the gas tube 85 in place and permits the gas tube to be positioned for optimum location for any given fuel. Thus, the tube 86 can be adjusted as well as the flame disk 88 in accordance with the solid fuel being burned.

It will, of course, be clear that the present burner is adapted to burn a variety of pulverized solid fuels of low density in addition to pulverized papers and other fibrous materials without departing from the spirit and scope of the invention.

Turning to FIGS. 7 and 8, an alternate spinner assembly 110 is shown for use in the nozzle in accordance with FIGS. 5 and 6 and has a gas pipe 111 having a plurality of vanes 112 attached therearound and thereto. Gas pipe 111 has a cone shaped opening 113, while the spinner vanes 112 provides a screw shape as shown in FIG. 8 and may also have sharpened edges 114. The cone shaped opening 113 may have the flame disk 115 positioned therein and mounted to the shaft 116, as shown in FIGS. 9 and 10. The flame disk 115 has a cone shaped 117 having a plurality of radially extending grooves 118 positioned at angles to form a flame disk in which stability is created at the face of the plate 113 by the creation of regions of rich mixture of gas at the exit opening space with lean zone between the angular grooves when positioned in the center of primary air and solid fuel nozzle and surrounded by primary air and solid fuel mixture of extremely high velocities. Conventional gas burner arrangements would not be stable in this type of an application because they would tend to blow out by the high velocity of the primary air passing the surface of the nozzle.

Turning to FIGS. 11 and 12, the gas spud 65 of FIG. 1 is shown having an exterior threaded portion 121 with a gas opening 122 and a gas opening 123 in a plurality of radial gas openings 124 extending therearound to provide a gas input in the middle of the secondary air entering the combustion chamber 21 of FIG. 1 and spinning in a direction opposite that of the primary ai air and solid fuel.

Figure 14:
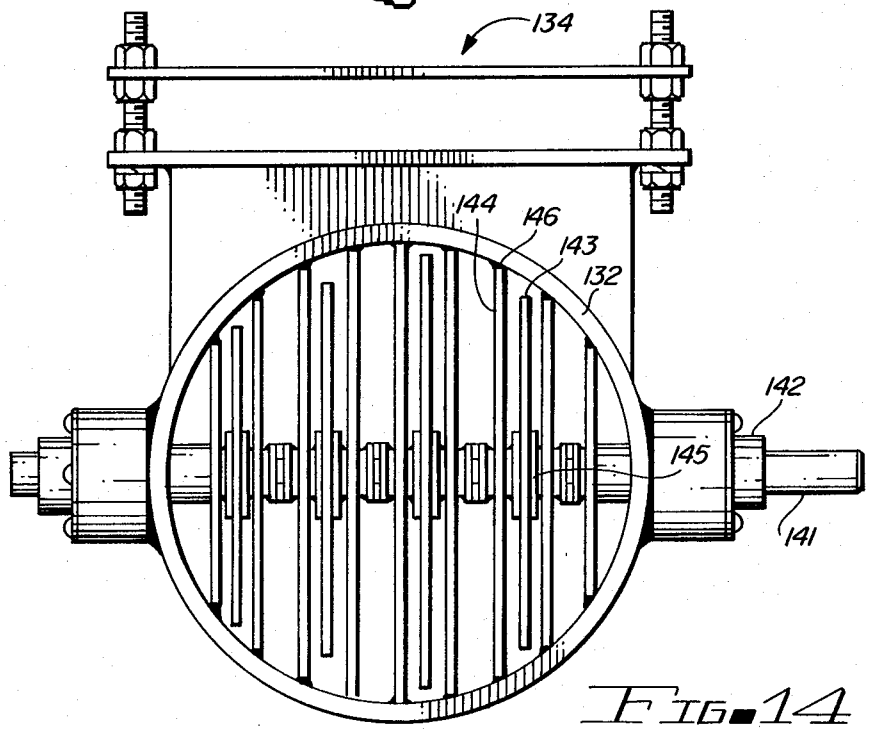
FIG. 14 is a sectional view taken on the line 14—14 of FIG. 13.

Turning now to FIGS. 13 through 15, a homogenizer unit 130 is shown connecting to the burner 20, solid fuel input nozzle 25 at the input 26 by flux pipe 131. The homogenizer 130 has the homogenizer casing 132 having an electric motor 133 mounted thereon on a mounting base 134 driving a belt 135 with a pulley 136, which in turn drives a pulley 137 to drive a plurality of blades in the homogenizer for shredding paper or biomass fuel in the primary air solid fuel line to break up the low density fiber solid fuels. Because of the nature of the fuel, which is typically pulverized paper waste, clumps or balling tend to form and the homogenizer prepares a more homogenious mixture for the input to the nozzles of the burner. The homogenizer has a coupling connection 138 coupling into the input 140. As seen in FIGS. 14 and 15, the pulley 137 is connected to a shaft 141 supported in a pair of journals 142 on either side of the homogenizer and has a plurality of blades 143 fixedly attached thereto for rotation therewith. The rapidly rotating blades tend to further pulverize the solid fuel and to break up clumps or balling just prior to the fuels being fed to the burners. As seen in FIG. 14, a plurality of spaced fixed dividing walls 144 space each four blades. Each four blades are attached to a mounting collar 145, which in turn, is attached to the shaft 141 while each spaced wall 144 has a shaft 141 passing therethrough and is attached to the housing 132 by well joints 146. The addition of this homogenizing unit in combination with the burner set forth in FIG. 1 and its specifically designed nozzles is especially effective in burning low density, low mass, fibrous fuels such as paper waste.

It should be clear at this point that a solid fuel burner has been provided for burn low density, low mass, fibrous type fuel such as paper and biomass with a stabilized flame in a combustion chamber. It should also, however, be clear that the present burner can operate entirely on gas if pulverized solid fuel is not available and that a wide variety of adjustments can be made to the burner from outside of the burner. Two different types of solid fuel nozzles are interchangeable which makes the combustion burner extremely flexible for adjusting the flame and burn for various types of solid fuels and is especially useful for boilers or furnaces that do not have available hot secondary combustion air such as applications requiring smaller size burners that require adjustable flame lengths. Accordingly, the present invention is not to be construed as limited to the forms shown, which are to be considered illustrative rather than restrictive.

I claim:

1. A solid fuel burner comprising in combination:

a combustion chamber;

a solid fuel and primary air nozzle attached to said combustion chamber for directing pulverized solid fuel and air into said combustion chamber;

solid fuel primary air spinning means for spinning said solid fuel and primary air into said combustion chamber in one direction of rotation;

secondary air input means for feeding secondary air into said combustion chamber;

secondary air spinning means for spinning the secondary air from said secondary air input means into said combustion chamber in a direction of rotation opposite in direction from said solid fuel and primary air;

gas fuel input having a flame disk positioned to feed gas into said combustion chamber in the center portion of said solid fuel and primary air nozzle; and an auxiliary gas spud extending into said combustion chamber for directing gas thereinto, whereby said solid fuel burner is adapted to burn low density, low mass solid fuels.

2. A solid fuel burner in accordance with claim 1, in which said auxiliary gas spud has at least one center outlet and a plurality of radially extending outlets.

3. A solid fuel burner in accordance with claim 1, including a homogenizer means located in the inlet to said solid fuel and primary air nozzle for breaking up clumps of solid fuel prior to directing said solid fuel and primary air into said solid fuel and primary air nozzle.

4. A solid fuel burner in accordance with claim 3, in which said homogenizer means has a housing and a plurality of blades therein attached to a rotating shaft extending through said housing.

5. A solid fuel burner in accordance with claim 4, in which said homogenizer means has a plurality of parallel spaced walls mounted therein and attached to said housing and having said rotating shaft extending therethrough with said homogenizer means blades attached to said shaft between said fixed walls.

6. A solid fuel burner in accordance with claim 5, in which said homogenizer means rotating shaft is connected to an electric motor for rotation thereof.

7. A solid fuel burner in accordance with claim 6, in which said homogenizer means rotating shaft is mounted in bearings mounted to said housing and has a pulley attached to one end thereof and is being connected by a belt to a pulley on an electrical motor mounted on said homogenizer means housing.

8. A solid fuel burner in accordance with claim 1, in which said solid fuel primary air spinning means includes a plurality of vanes mounted in said solid fuel and primary air nozzle.

9. A solid fuel burner in accordance with claim 8, in which said plurality of vanes are spiraling vanes mounted around said gas fuel input.

10. A solid fuel burner in accordance with claim 9, in which said plurality of vanes each has a sharpened edge for mixing and breaking up solid fuel and the primary air in the solid fuel and primary air nozzle.

11. A solid fuel burner in accordance with claim 1, in which said gas fuel input has a cone shaped ending and said flame disk has a cone shape positioned in the gas fuel input cone shape ending.

12. A solid fuel burner in accordance with claim 11, in which said flame disk has a plurality of radially extending grooves in the cone shaped portion thereof.

13. A solid fuel burner in accordance with claim 12, in which said flame disk radially extending grooves are angled grooves adapted to produce a predetermined gas pattern.

14. A solid fuel burner in accordance with claim 13, in which said gas fuel input flame disk is attached to a shaft extending through said gas fuel input and through said burner housing and has a handle attached thereto for adjusting said flame disk from outside said solid fuel burner.

* * * * *